US011031719B2

(12) United States Patent
Somanathapura Ramanna

(10) Patent No.: US 11,031,719 B2
(45) Date of Patent: Jun. 8, 2021

(54) POWER CONNECTOR

(71) Applicant: Molex, LLC, Lisle, IL (US)

(72) Inventor: Nrupathunga Chakravarthy Somanathapura Ramanna, Bangalore (IN)

(73) Assignee: Molex, LLC, Lisle, IL (US)

( * ) Notice: Subject to any disclaimer, the term of this patent is extended or adjusted under 35 U.S.C. 154(b) by 56 days.

(21) Appl. No.: 15/768,775

(22) PCT Filed: Oct. 28, 2016

(86) PCT No.: PCT/US2016/059367
§ 371 (c)(1),
(2) Date: Apr. 16, 2018

(87) PCT Pub. No.: WO2017/075383
PCT Pub. Date: May 4, 2017

(65) Prior Publication Data

US 2018/0301842 A1 Oct. 18, 2018

(30) Foreign Application Priority Data

Oct. 29, 2015 (IN) ..... 1116/KOL/2015

(51) Int. Cl.
*H01R 13/436* (2006.01)
*H01R 13/28* (2006.01)
(Continued)

(52) U.S. Cl.
CPC ..... *H01R 13/4367* (2013.01); *H01R 13/28* (2013.01); *H01R 13/506* (2013.01); *H01R 24/84* (2013.01); *H01R 13/432* (2013.01)

(58) Field of Classification Search
CPC .. H01R 13/28; H01R 13/506; H01R 13/4367; H01R 13/432
See application file for complete search history.

(56) References Cited

U.S. PATENT DOCUMENTS 3,178,669 A * 4/1965 Roberts ..... H01R 13/28 428/573
4,963,102 A * 10/1990 Gettig ..... H01R 13/28 439/291

(Continued)

FOREIGN PATENT DOCUMENTS

CN 101552388 A 10/2009
WO WO 2015-017501 A1 2/2015
WO 2017/075383 A1 5/2017

OTHER PUBLICATIONS

International Search Report and Written Opinion received for PCT application No. PCT/US2016/059367, dated Jan. 19, 2017, 11 pages.

(Continued)

*Primary Examiner* — Briggitte R. Hammond

(57) ABSTRACT

A connector is disclosed including a housing and a pair of terminals. Each terminal includes a U shaped body portion and a mounting portion formed at the first end of the body portion with a bent contacting portion disposed at a therebetween. A wire securing portion is formed at the second end of the body portion with a pair of crimping portions to secure the wire to the terminal. The body portion and the mounting portion are received in a slots formed in the housing with the contacting portion extending through a window formed in the housing and the terminal mounting portion being translatable within the slot. A TPA device is secured to the housing that blocks the terminal from being removed from the housing.

11 Claims, 18 Drawing Sheets

(51) Int. Cl.

| | |
|---|---|
| ***H01R 13/506*** | (2006.01) |
| ***H01R 13/432*** | (2006.01) |
| ***H01R 24/84*** | (2011.01) |

(56) References Cited

U.S. PATENT DOCUMENTS

| | | | | |
|---|---|---|---|---|
| 5,199,900 | A | 4/1993 | Hayes, Sr. | |
| 5,575,692 | A * | 11/1996 | Cecil, Jr. | H01R 13/4368 439/752 |
| 6,004,153 | A * | 12/1999 | Myer | H01R 13/641 439/352 |
| 6,179,660 | B1 * | 1/2001 | Salaguinto | H01R 13/424 439/585 |
| 6,261,115 | B1 * | 7/2001 | Pederson | H01R 13/6272 439/352 |
| 7,252,562 | B1 * | 8/2007 | Chen | H01R 13/187 439/852 |
| 7,867,042 | B2 | 1/2011 | Shuey | |
| 8,016,606 | B1 * | 9/2011 | Kwan | H01R 13/641 439/352 |
| 9,039,462 | B2 * | 5/2015 | Yoon | H01R 13/4365 439/752 |
| 9,551,483 | B1 * | 1/2017 | Mostoller | H01R 24/20 |
| 9,935,389 | B1 * | 4/2018 | Irish | H01R 13/4365 |
| 2002/0086575 | A1 * | 7/2002 | Marpoe, Jr. | H01R 13/64 439/352 |
| 2005/0176298 | A1 * | 8/2005 | Flowers | H01R 13/4365 439/595 |
| 2005/0227548 | A1 | 10/2005 | Sian | |
| 2006/0240718 | A1 * | 10/2006 | Osada | H01R 13/4365 439/752 |
| 2006/0286864 | A1 * | 12/2006 | Bethurum | H01R 4/4818 439/595 |
| 2007/0224888 | A1 | 9/2007 | Tyler et al. | |
| 2010/0055961 | A1 | 3/2010 | Martin et al. | |
| 2016/0118741 | A1 * | 4/2016 | Schmidt | H01R 13/6272 439/131 |
| 2017/0352985 | A1 * | 12/2017 | Venkatesan | H01R 13/639 |
| 2018/0301842 | A1 * | 10/2018 | Somanathapura Raman | H01R 13/4367 |

OTHER PUBLICATIONS

International Preliminary Report on Patentability received for PCT Application No. PCT/US2016/059367, dated May 11, 2018, 10 pages.

Office action received for EP application No. 16860897A, dated Jun. 30, 2020, 5 pages.

* cited by examiner

POWER CONNECTOR

RELATED APPLICATIONS

This application is a national stage of International Application No. PCT/US2016/059367, filed Oct. 28, 2016, which claims priority to Indian Provisional Application No. 1116/KOL/2015, filed Oct. 29, 2015, both of which are incorporated herein by reference in their entirety.

Field of the Invention

The present invention relates to field of connectors, more specifically the field of connectors suitable for providing power.

Description of Related Art

There currently exists a need for wire to wire connector systems, in particular systems that transmit power. A particular issue is that a unique plug and receptacle connector are generally required for the connector system. It is required that the corresponding components in these connectors are assembled properly and correctly. Generally, each of the connectors includes an insulative housing and an electrically conductive terminal that is secured to the end of a cable or wire lead. Connector systems generally include a plug and receptacle with corresponding male and female electrically conductive terminals.

Each connector requires a plurality of terminated lead wires inserted into respective cavities in the housing. In some instances, the conductive terminal may not be inserted in the correct manner or the wrong terminal is used resulting in damage to the corresponding terminal and electrical failure. Therefore a power terminal and a connector is desired that eliminates the potential these problems associated with a wire to wire connector system.

BRIEF SUMMARY

The present disclosure generally relates to an electrical power connector that can be integrated into a connector system and that can provide desirable operation under high current density conditions. In general, connectors are suitable for use as modular components within modular assemblies. For example, modular assemblies can take the form of wire-to-board or wire-to-wire connectors and can, when desired, provide a low-profile connector system.

A connector assembly may be provided that includes a hermaphroditic plug connector and a receptacle connector including one or more hermaphroditic blade-type power contacts disposed in each of the connector housings. The plug and receptacle connectors are constructed from an insulative material to form the housing, are slidably mateable with each other and include corresponding molded cavities to receive the electric terminals within the housing.

In an embodiment the terminals are constructed with a planar body portion and a planar securing portion with a bent beam contacting portion disposed therebetween. The cavities include a terminal retention slot for securing the planar sections of the terminal within the housing cavity. Additionally the planar portions of the terminal are constructed so that interference exists between the planar portions of the terminal and certain cavity openings and terminal orientations prohibiting incorrect assembly of the terminals to the housing cavities. Additionally, a Terminal Position Assurance, TPA device is used to verify the position and orientation of the terminal with respect to the connector housing.

BRIEF DESCRIPTION OF THE DRAWINGS

The present invention is illustrated by way of example and not limited in the accompanying figures in which like reference numerals indicate similar elements and in which.

DETAILED DESCRIPTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

The appended figures illustrate an embodiment of the current disclosure and it is to be understood that the disclosed embodiment is merely exemplary of the disclosure, which may be embodied in various forms. Therefore, specific details disclosed herein are not to be interpreted as limiting, but merely as a basis for the claims and as a representative basis for teaching one skilled in the art to variously employ the present disclosure.

Figure 1:
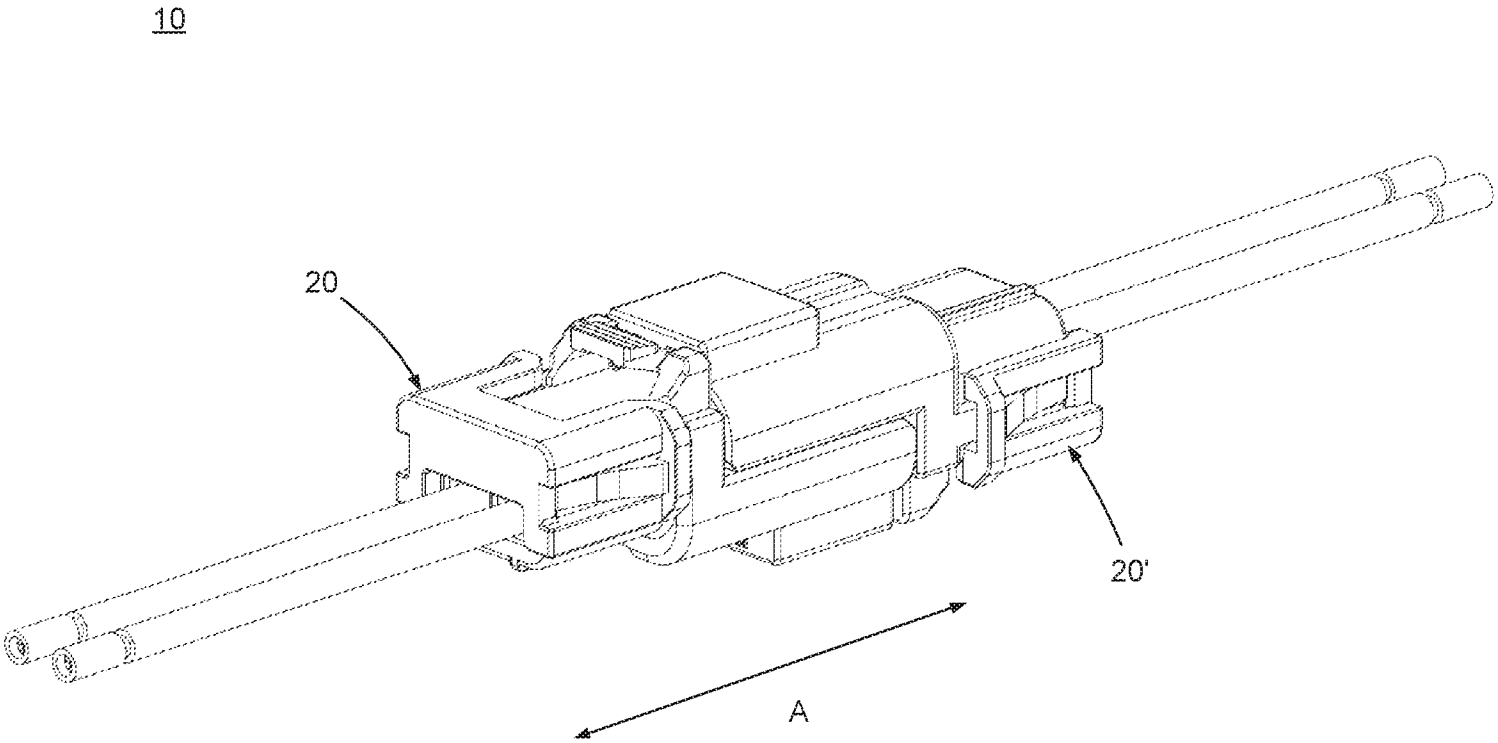
FIG. 1 is a perspective view of a connector system of the present disclosure.
Figure 2:
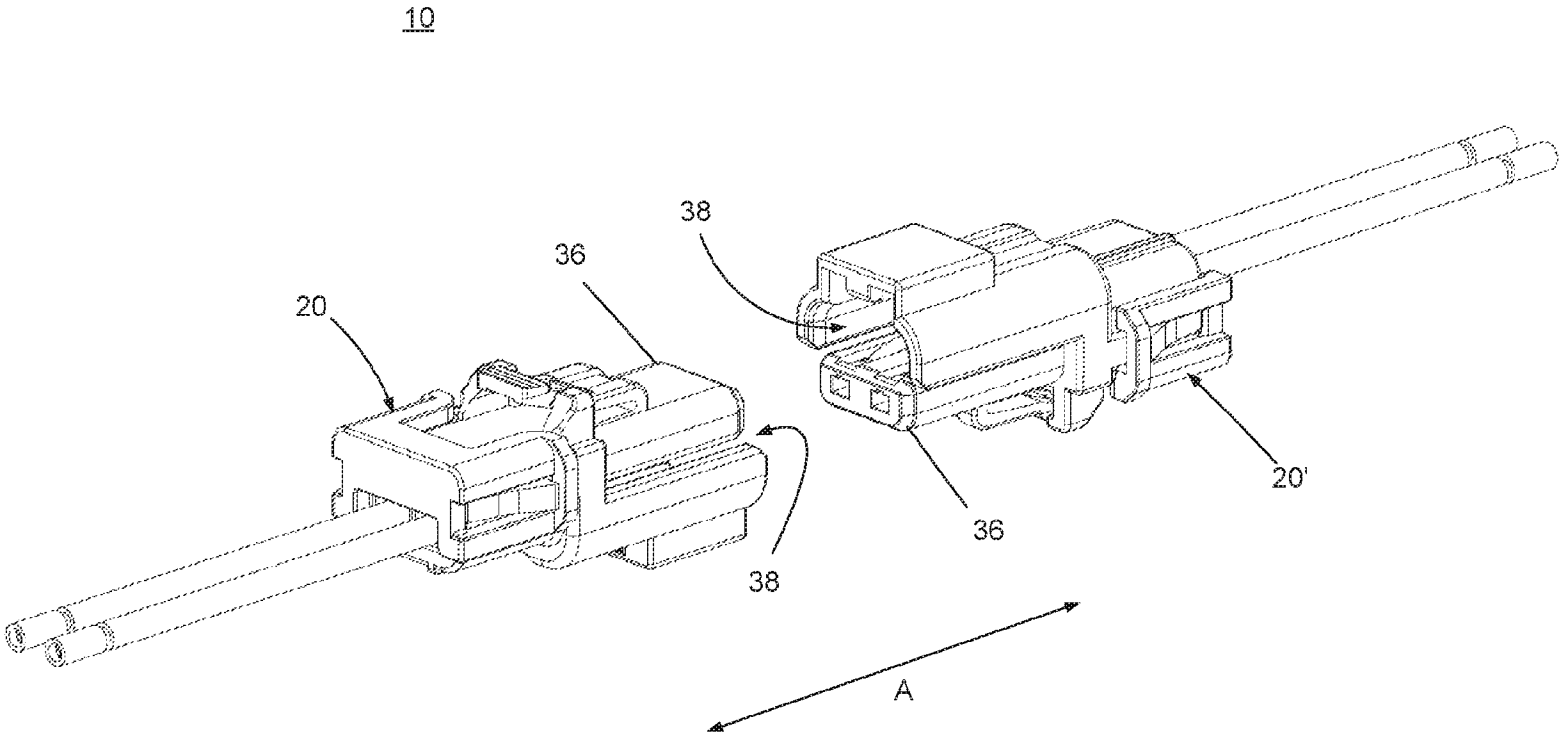
FIG. 2 is a perspective view of the connector system of FIG. 1 wherein the connectors are unmated.
Figure 3:
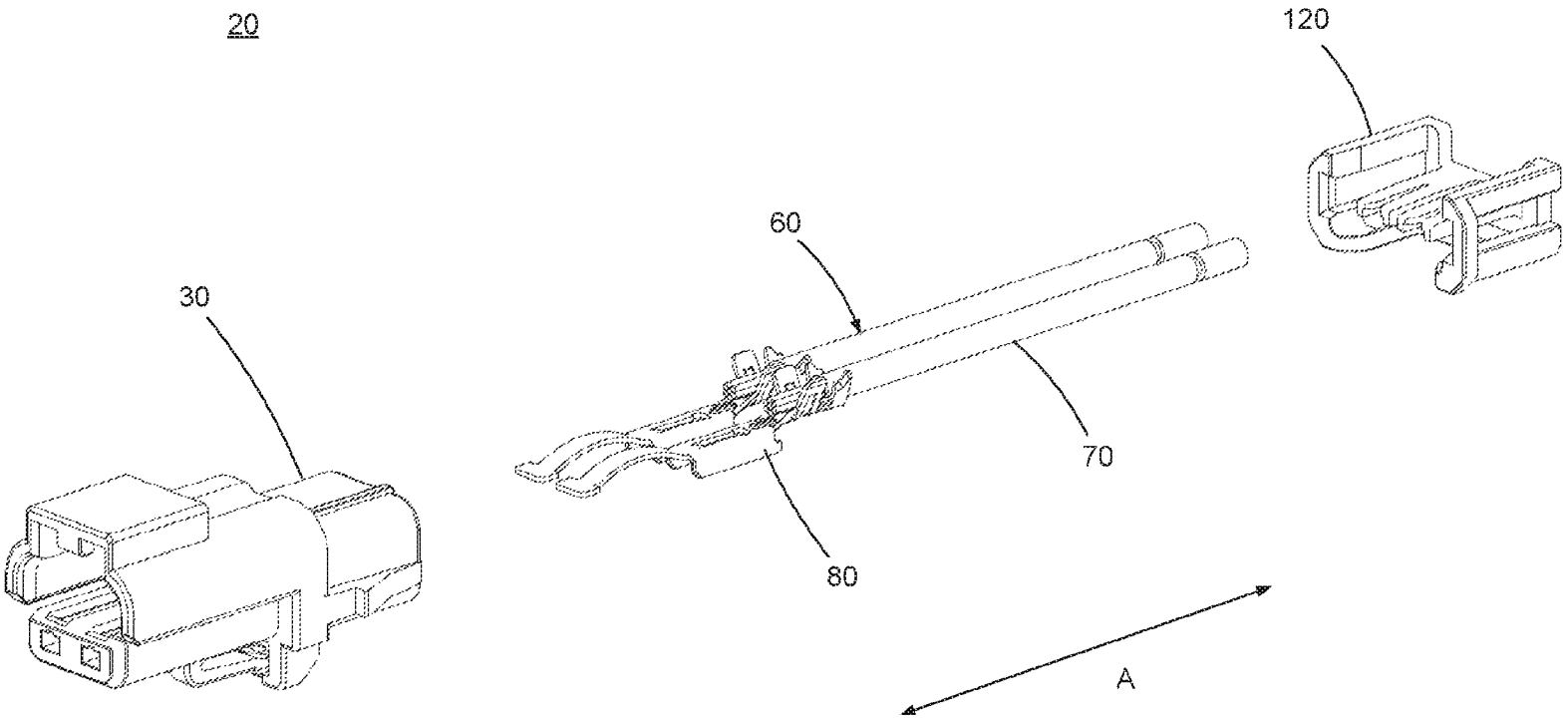
FIG. 3 is an exploded view of a connector of the connector system of FIG. 1.

As shown in FIGS. 1-3 a wire to wire connector system 10 is depicted has having a first connector 20 and a second connector 20' that are removeably locked together. The connector system is of the hermaphroditic type, that is, that each connector is a duplicate and can be connected together with itself. As can be appreciated, the electrical terminals are also hermaphroditic and can connect to themselves. Since both the first connector 20 and the second connector 20' are exactly the same, only one of the connectors 20 shall be described.

As shown in the FIG. 2 the hermaphroditic power connector system 10 includes a first connector 20 and a second connector 20' that are mated together about an axis A. The axis A also defines the insertion or mating direction of the connector system 10. FIG. 3 shows the connector 20 including an insulative housing 30, a pair of terminal leads 60 and a terminal position assurance device 120 commonly referred to as a TPA. In the embodiment shown, a two circuit connector system is described, but connector systems having more than two circuits can be appreciated. In operation, the connector system 10 includes an identical connector 20 for respectively mating with each other. As further illustrated in FIGS. 2 and 7, each connector includes a housing 30 having a terminal receiving portion 36 and an opening 38, whereby the opening 38 is configured to accept the terminal receiving portion 36 of the mating or second connector 20'.

The housing 30 includes a cavity 50 configured for receiving electrically conductive terminals 80 of a terminal lead wire 60 therein. The cavity 50 is formed along the mating axis A of the connector 20 and extends through the housing 30 with a first end corresponding to the terminal mounting portion 36 of the connector 20 and a second end corresponding to the terminal receiving portion 34. The terminal receiving portion 34 includes an opening for receiving the terminals 80 upon insertion of the terminal lead wire 70. The terminal receiving portion 36 of the housing 30 includes a window 56 that defines a passage between the cavity 50 and the opening 38.

Figure 4:
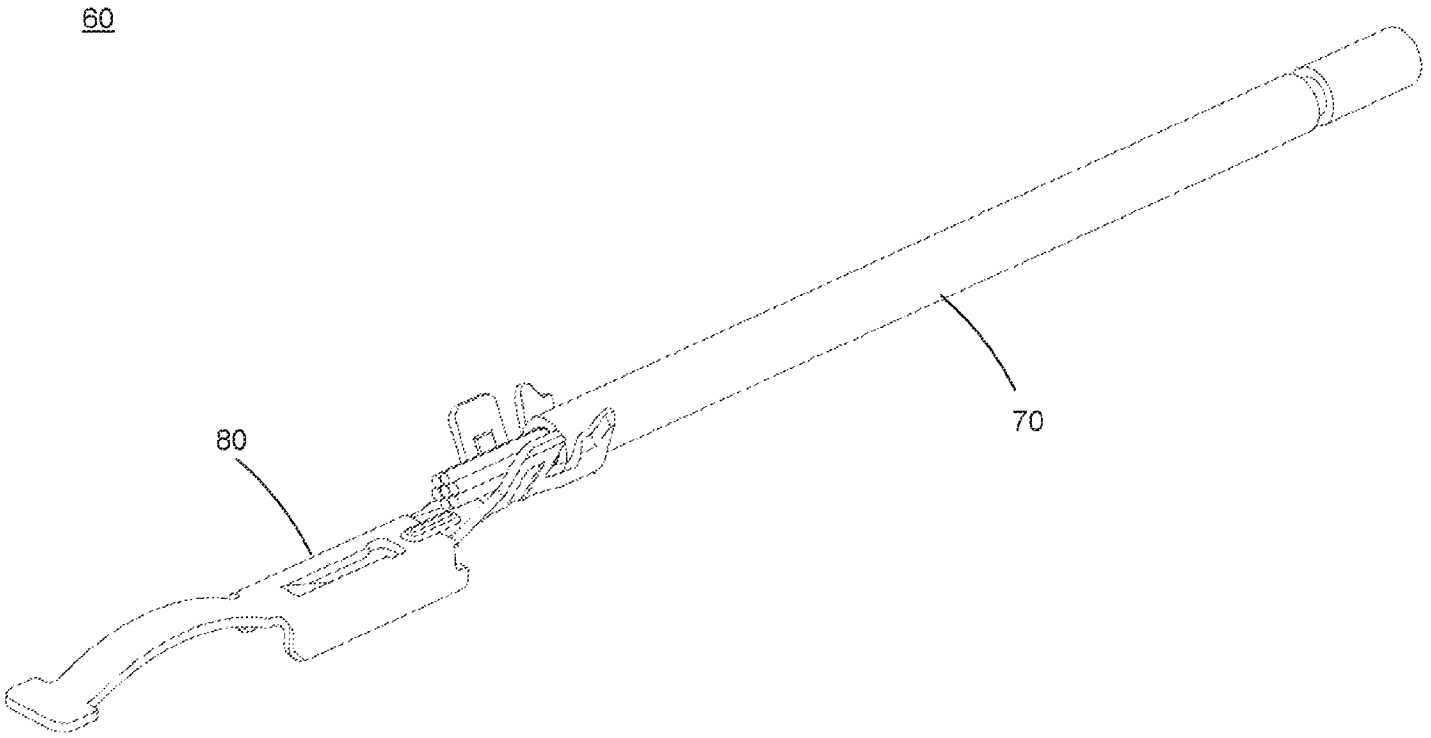
FIG. 4 is a perspective view of a lead wire assembly of the connector of FIG. 3.
Figure 5:
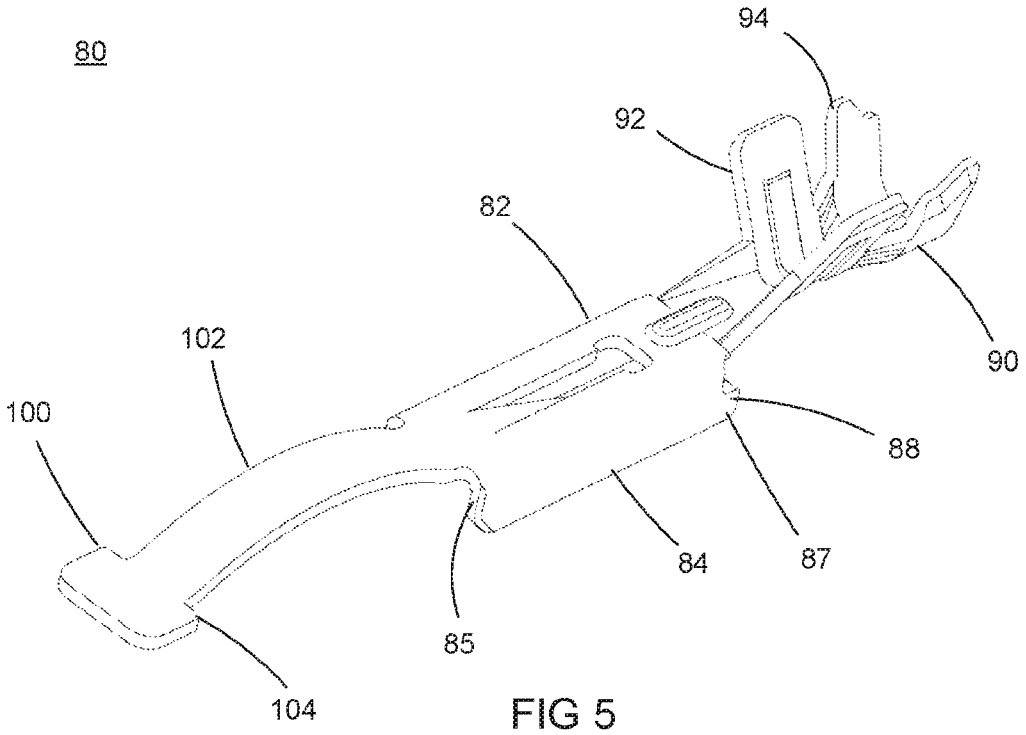
FIG. 5 is a perspective view of the terminal of an embodiment of the present disclosure.
Figure 6:
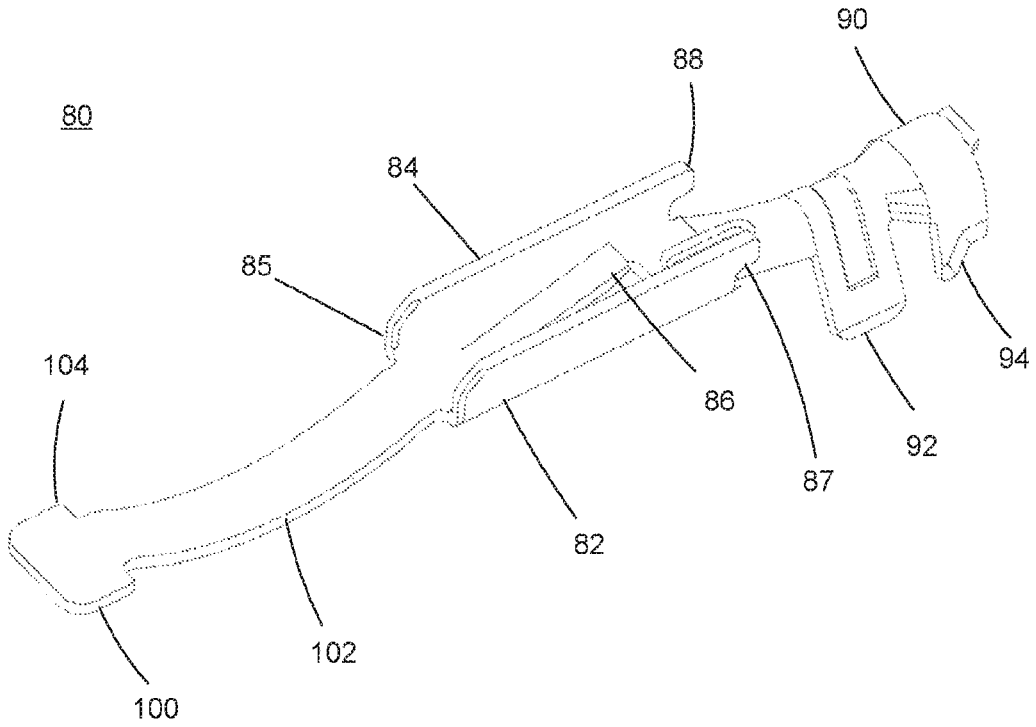
FIG. 6 is an alternative perspective view of the terminal of FIG. 5.

As depicted in FIG. 4 the terminal lead wire 60 includes an electrically conductive terminal 80 and a lead wire 70 attached to the terminal 80. In the embodiment shown, the terminal includes a mating end 100 extending from a body portion 82 and a mounting end 90 also extending from the body 82 as best illustrated in FIGS. 5 and 6. The mounting end 90 includes a section for crimping the lead wire 70 to the terminal 80. A first pair of wings 92 is crimped directly to the conductors of the lead wire 70 and a second pair of wings 94 is crimped to the insulating portion of the lead wire 70. A terminal securing section 104 is formed at the mating end 100 of the terminal 80 with a contacting portion 102 defined between the body portion 82 and the terminal securing section 104. The contacting portion 102 is bent and forms a spring beam therebetween.

The body 82 of the terminal 80 is formed in the shape of a "U" shaped channel and includes a pair of rails 84 formed along each side of the body 82. Each rail 84 includes a shoulder 85 formed adjacent the mounting end 100 and a tab 87 having stop surface 88 formed adjacent the mounting end 90. A locking tang 86 is formed in the body 82 and is bent in a direction so as to be positioned between the rails 84.

Figure 7:
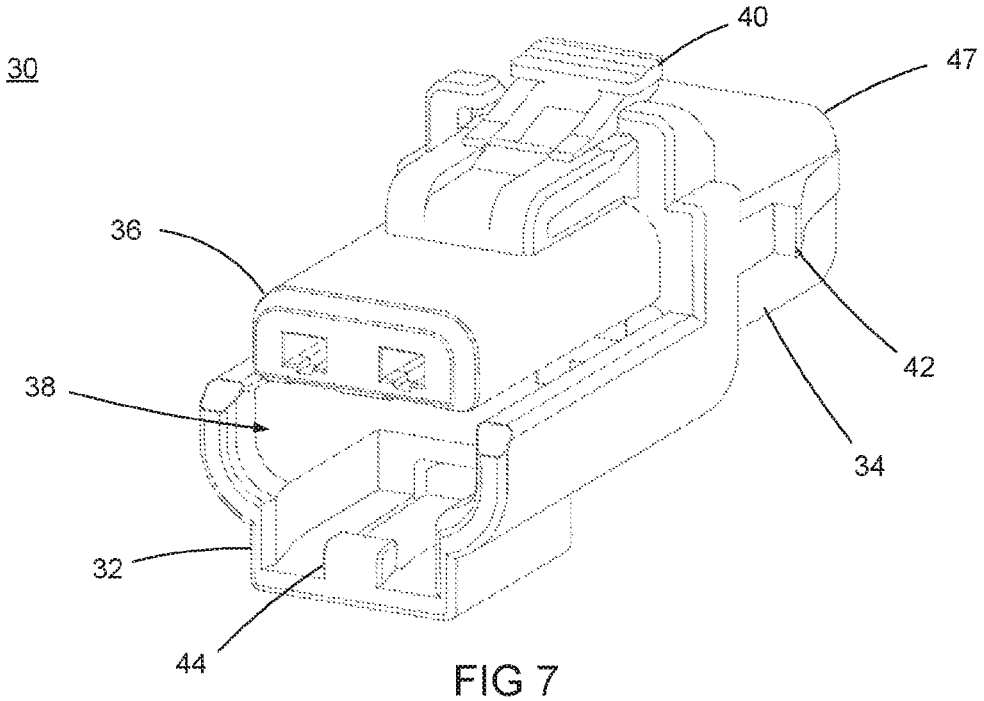
FIG. 7 is a perspective view of the housing of the connector of the present disclosure.

As best shown in FIGS. 7-10, the housing 30 is formed from an insulative material and includes a terminal receiving end 36 and a mounting end 34. As previously described, the connector is a hermaphroditic type and therefore the plug connector and receptacle connector are exactly the same and cooperatively mate with each other. In the embodiment shown the connector assembly 10 is shown as a two circuit. As illustrated the connector 20 includes a pair of cavities 50 formed through the housing 30 extending between the mounting end 34 and the terminal receiving end 36 along the mating axis A. As best shown in FIG. 7, the housing 30 includes an opening 38 configured to receive the terminal receiving end 36 of a cooperating connector 20 therein. A lock 40 is formed on the exterior of the housing 30 and engages a ramp 44 formed in the opening 38 of a mating connector 20 to secure the connectors together in a mated arrangement.

Figure 8:
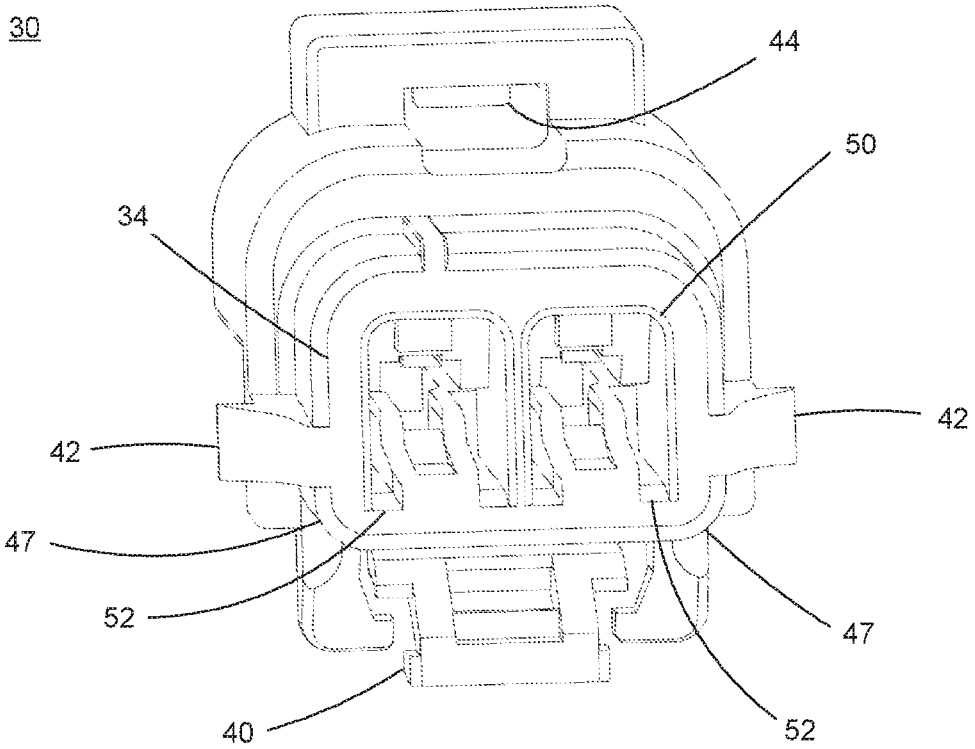
FIG. 8 is an alternative perspective view of the housing of FIG. 7.

As best shown in FIG. 8 the mounting end 34 of the housing 30 includes an exterior profile having a generally rectangular shape. In the embodiment shown, a pair of cavities 50 is shown for a two circuit connector system 10. On the exterior sides of the housing 30 a pair of ramps 42 are formed adjacent the cavities 50. The profile of the mounting end 34 of the housing 30 includes a guiding surface 47.

Figure 9:
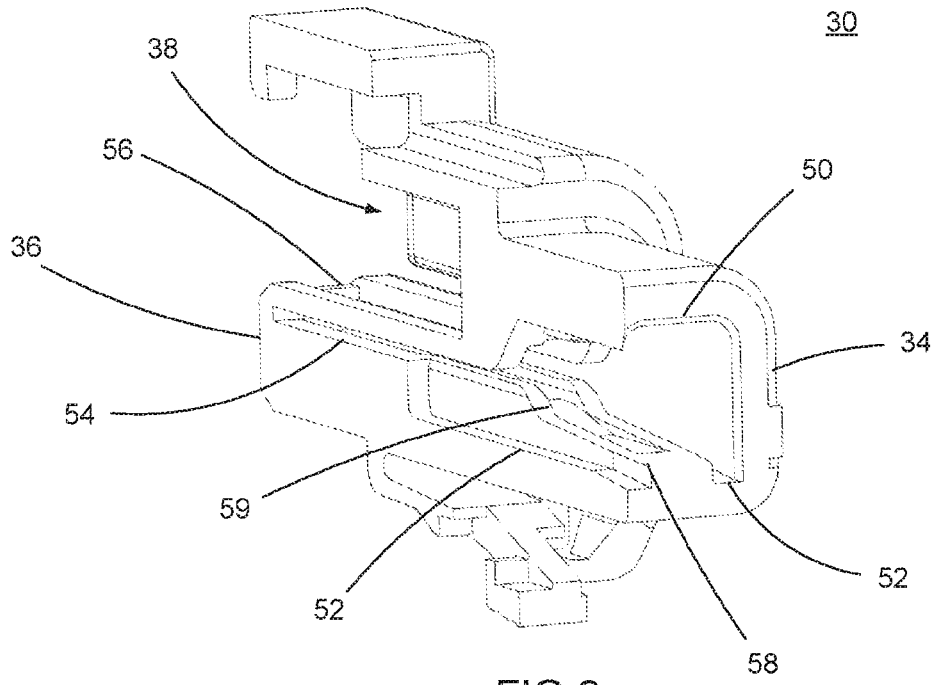
FIG. 9 is a section view of the housing of FIG. 7.
Figure 10:
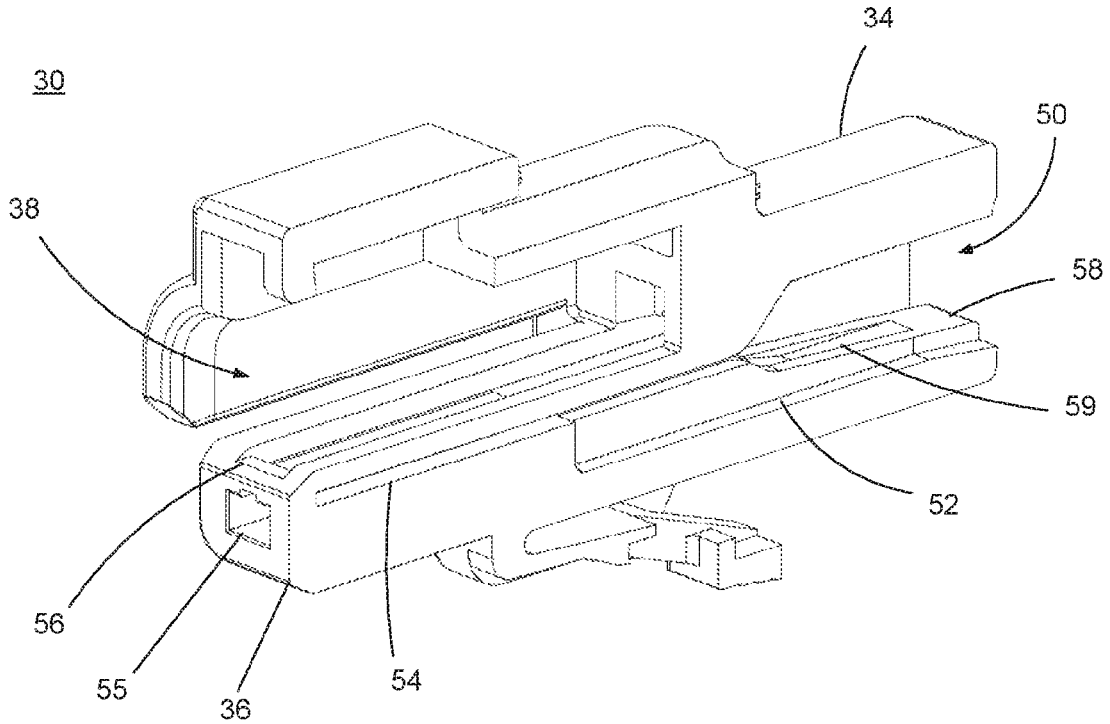
FIG. 10 is an alternative perspective of the section view of FIG. 9.
Figure 21:
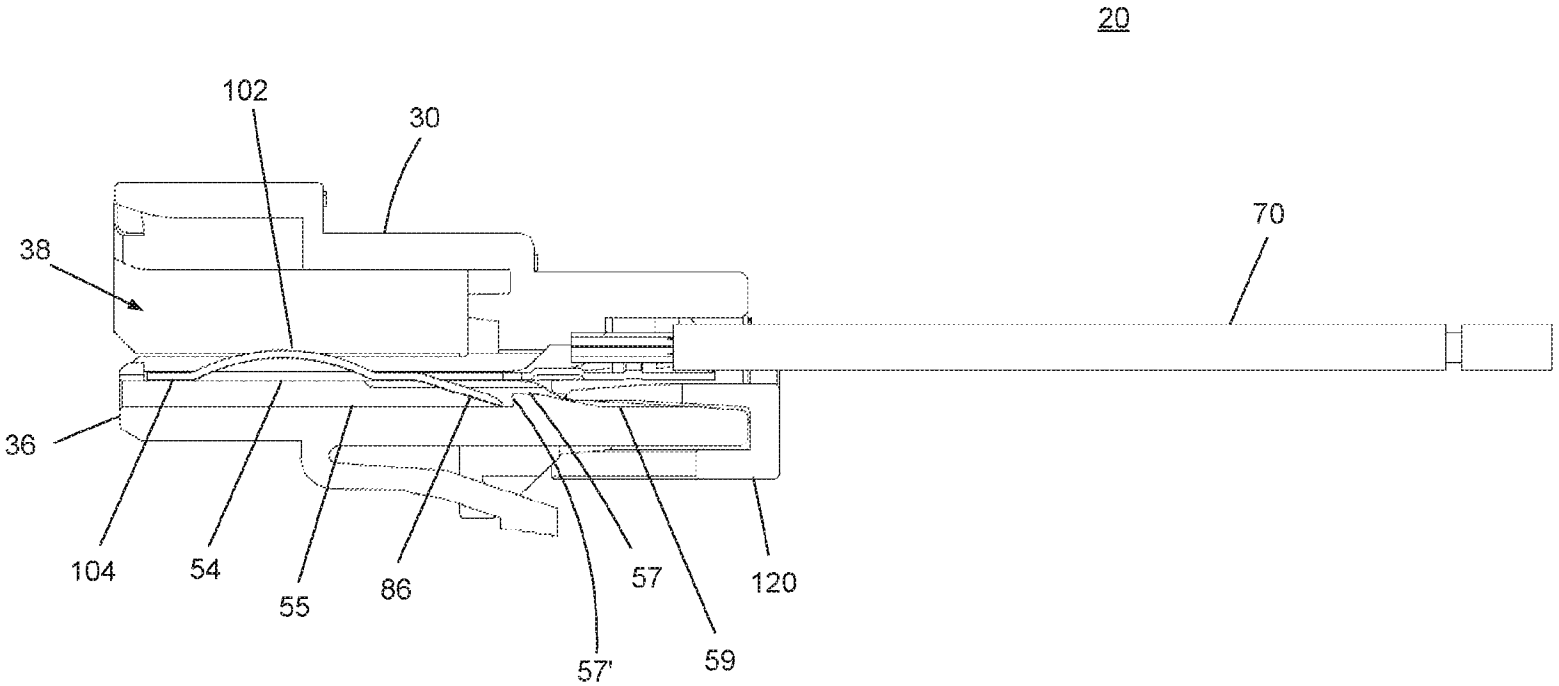
FIG. 21 is section view of the connector assembly of the present disclosure.

As best shown in FIGS. 9-10, the housing 30 is shown in section and the cavity 50 is depicted in the cut away view. The cavity 50 is formed in the housing 30 along the mating axis A and includes an opening extending from the mounting end 34 to the terminal receiving end 36. A center rib or protrusion 58 is defined by a pair of vertical slots 52 formed in the cavity 50 near the receiving end 34 of the housing 30. The protrusion 58 interposed between the slots 52. A recess 59 is formed in the protrusion 58 along the mating axis A. A locking ramp 57 is disposed in the recess 59 with the locking ramp 57 further including a stop surface 57' as best shown in FIG. 21. As best depicted in FIG. 10 a window 56 is formed in the housing 30 near the mounting end 36. The window 56 defines a passage between the opening 38 and the cavity 50. Horizontal slots 54 are formed on each side of the cavity 50 and extend along the window 56 in the passage.

Figure 11:
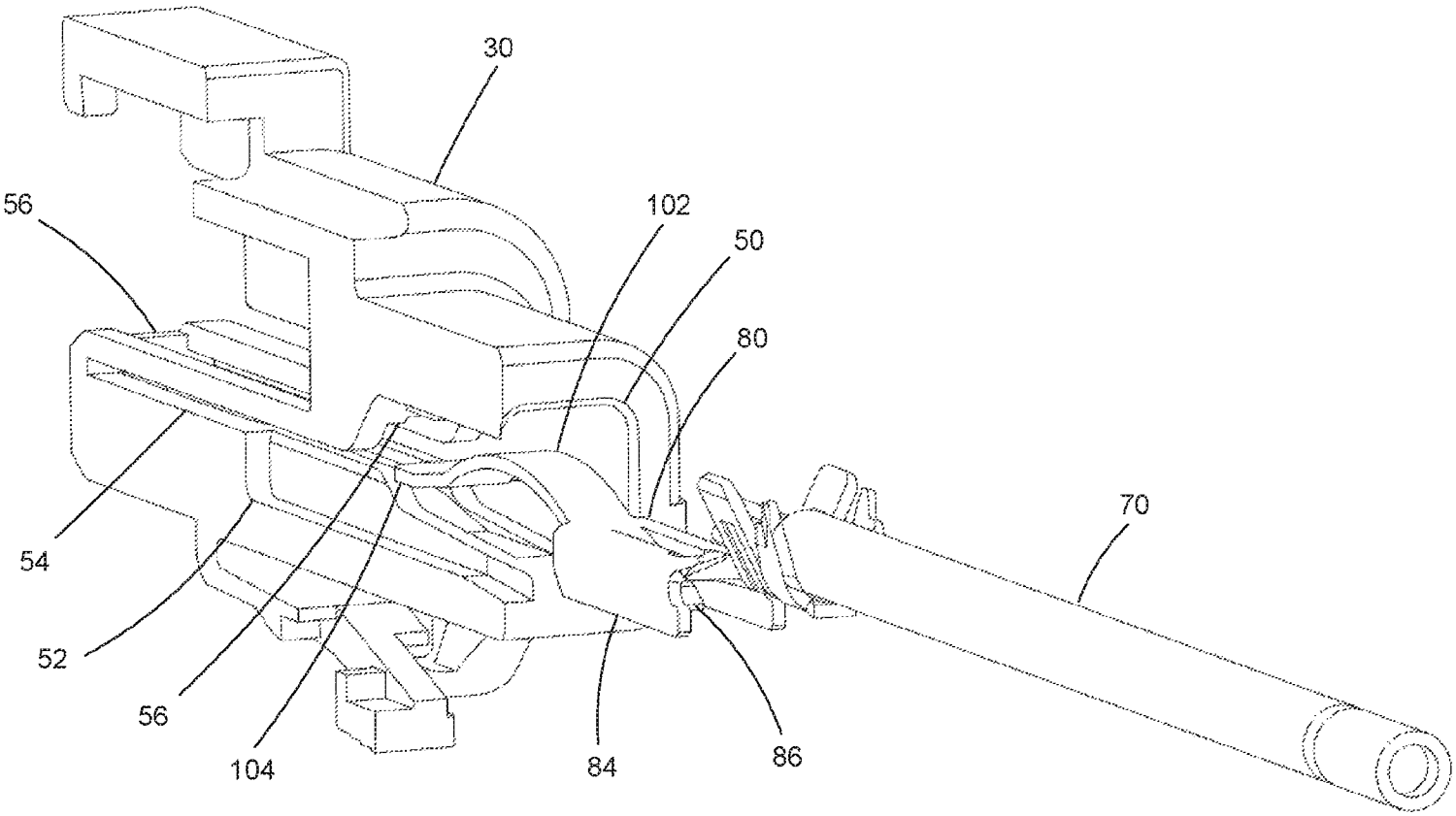
FIG. 11 is a partially section view showing a sequence of terminal insertion of the connector of the present disclosure.
Figure 12:
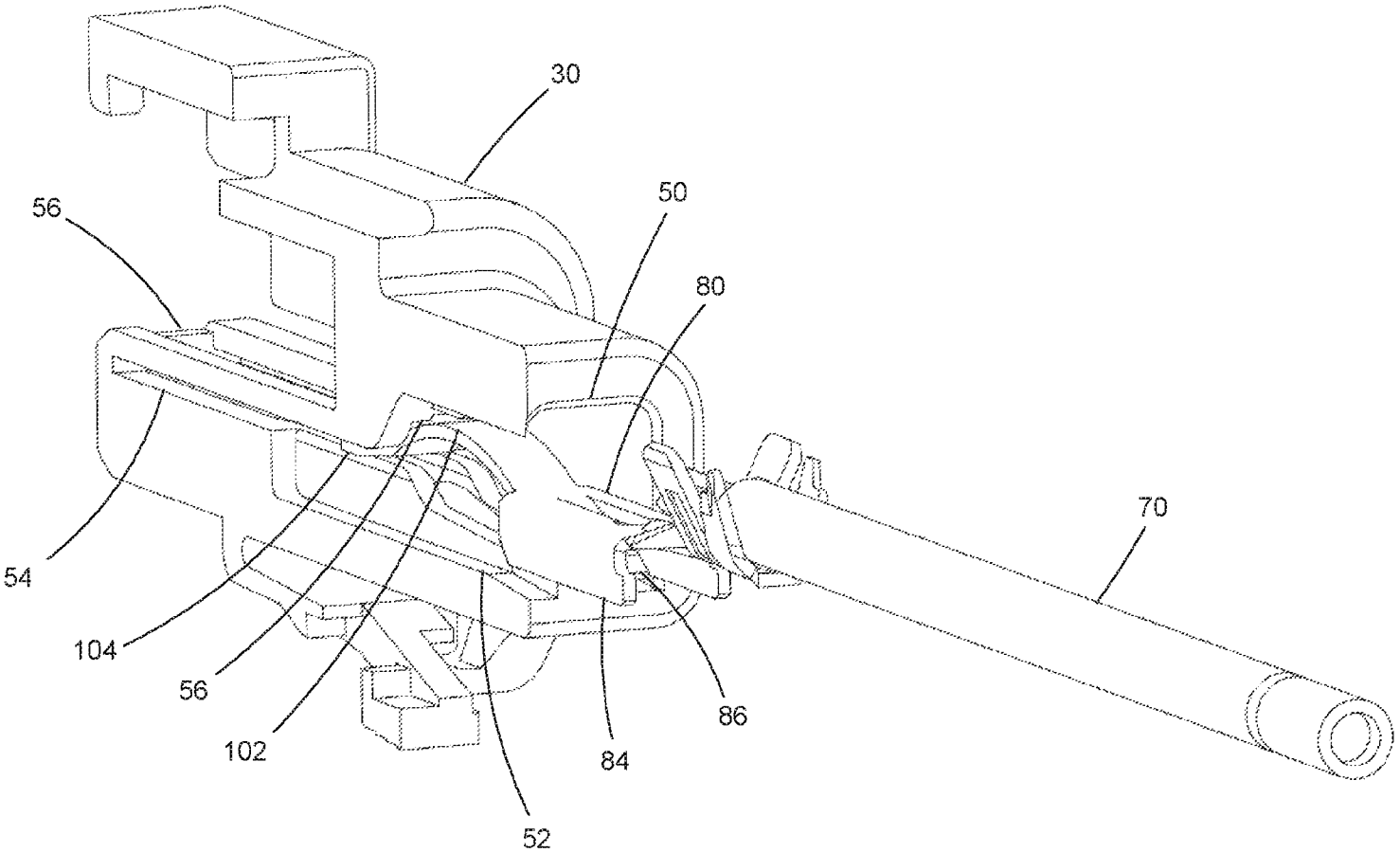
FIG. 12 is a partially section view showing an additional sequence of terminal insertion of the connector of the present disclosure.
Figure 13:
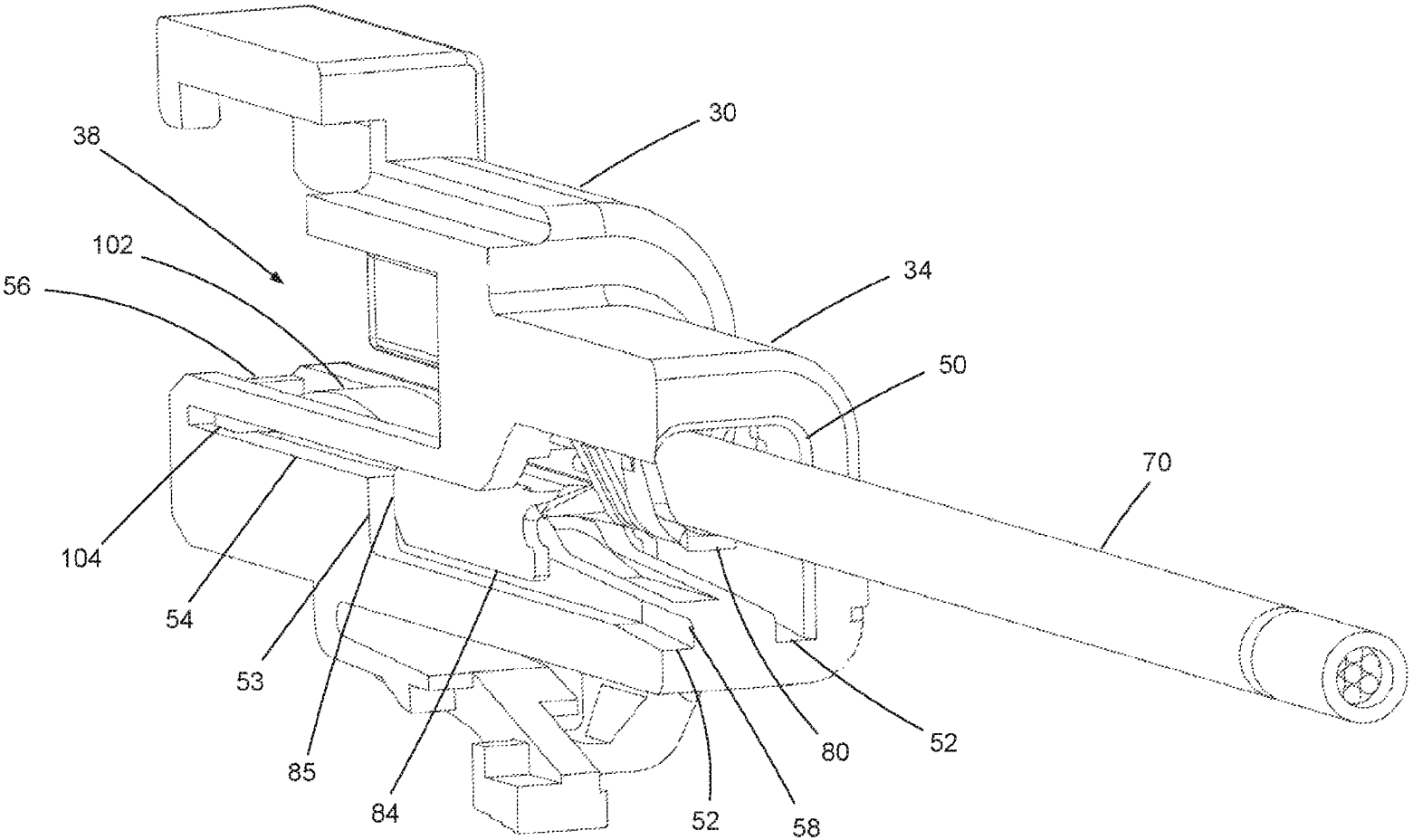
FIG. 13 is a partially section view showing an additional sequence of terminal insertion of the connector of the present disclosure.
Figure 14:
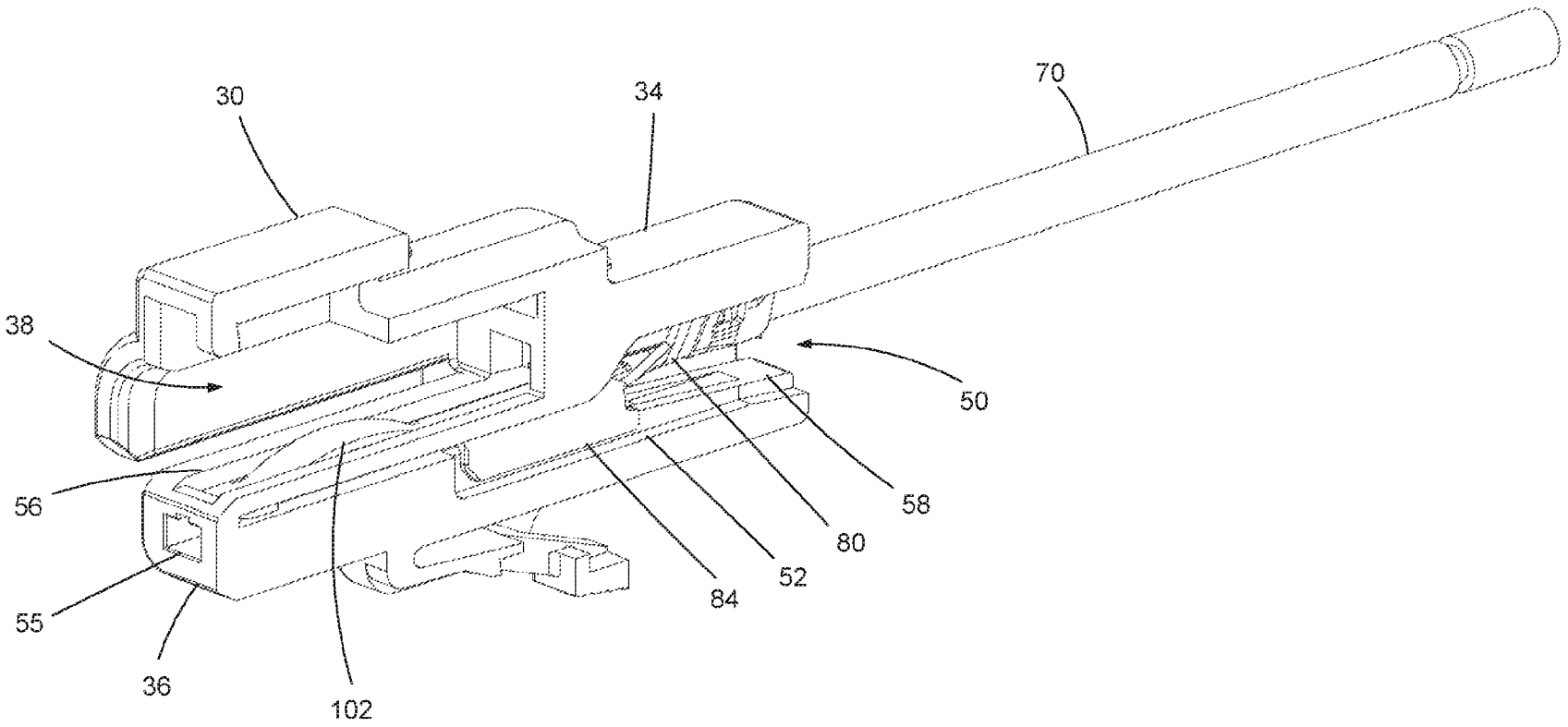
FIG. 14 is an alternative perspective view of FIG. 13.

The insertion of the terminal lead wire 70 into the housing 30 is best illustrated in FIGS. 11-14. FIGS. 11-14 depict the sequence that occurs during which the lead wire 70 is inserted into the housing 30. The terminal lead wire 70 is installed into the connector along an insertion direction that corresponds to the mating axis A. As shown in FIG. 11 the mating end 100 of the terminal 80 of the terminal lead wire 70 is first inserted into the cavity 50 with the securing section 104 of the terminal 80 aligned with the slots 54 and the rails 84 aligned with the slots 52.

Upon further advance of the terminal 80 into the cavity 50, the securing section 104 and the rails 84 respectively slide along the slots 54 and slots 52 until the shoulder 85 formed on the rails abuts the interior end or shoulder stop 53 of each channel 52. As illustrated in FIG. 21 upon insertion of the terminal 80 to its final position, the tang 86 is guided by recess 59 and is deflected over the locking ramp 57 formed in the protrusion 58. In this position, the tang 86 snaps back behind the locking ramp 57 and engages the locking surface 57' resisting pull out upon full insertion of the terminal 80.

Figure 15:
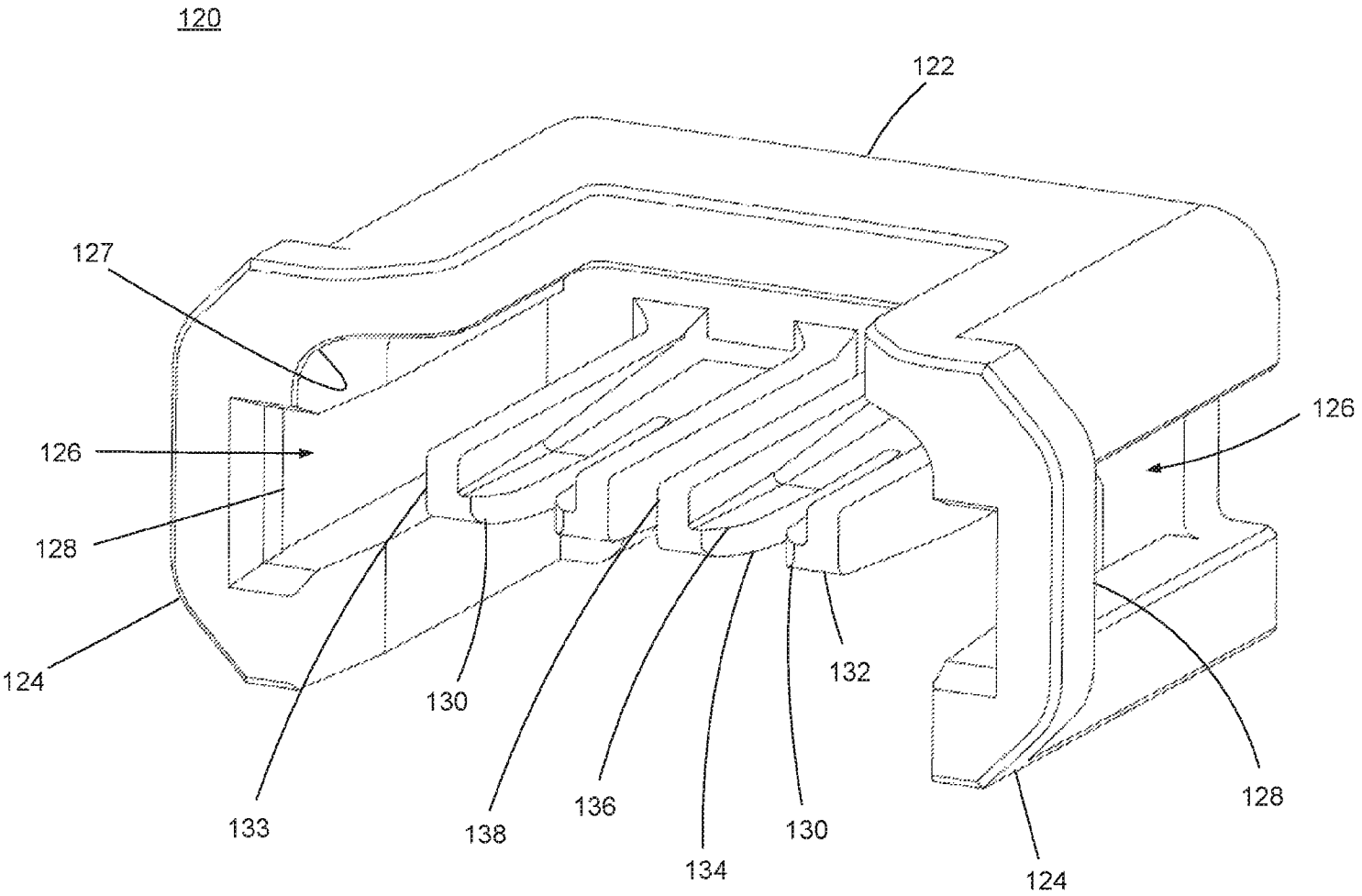
FIG. 15 is a perspective view of the TPA device of the connector of the present disclosure.

Once the terminal lead wires 60 are inserted and retained in the cavities 50 that are formed in the housing 30 a terminal position assurance device, TPA 120 is installed on the connector housing 30. As illustrated in FIG. 15 the TPA 120 is generally "U" shaped and generally formed from an insulative material and includes a base 122, a latching arm 124 extending from opposite sides of the base 122 defining a space between the latching arms 124 and a guiding surface 127 defined along each arm 124. Each arm 124 further includes a cutout formed therein defining an opening 126 with each opening 126 having a stop shoulder 128.

A locking arm 130 extends from the base 122 and corresponds to each cavity 50 formed in the housing 30. Each securing arm 130 includes a pair of side walls or projections 138 and a connecting wall 132 connecting the side walls 138 that define a "U" shaped beam. A slot 134 is formed in the connecting wall 132 between the side walk of the each securing arm 130 allowing the securing arm 130 to deflect or expand in a lateral direction normal to the mating axis A. With the slot 134, independent "L" shaped beams are essentially created on each securing arm 130 that can deflect or bend independently of one another.

Figure 16:
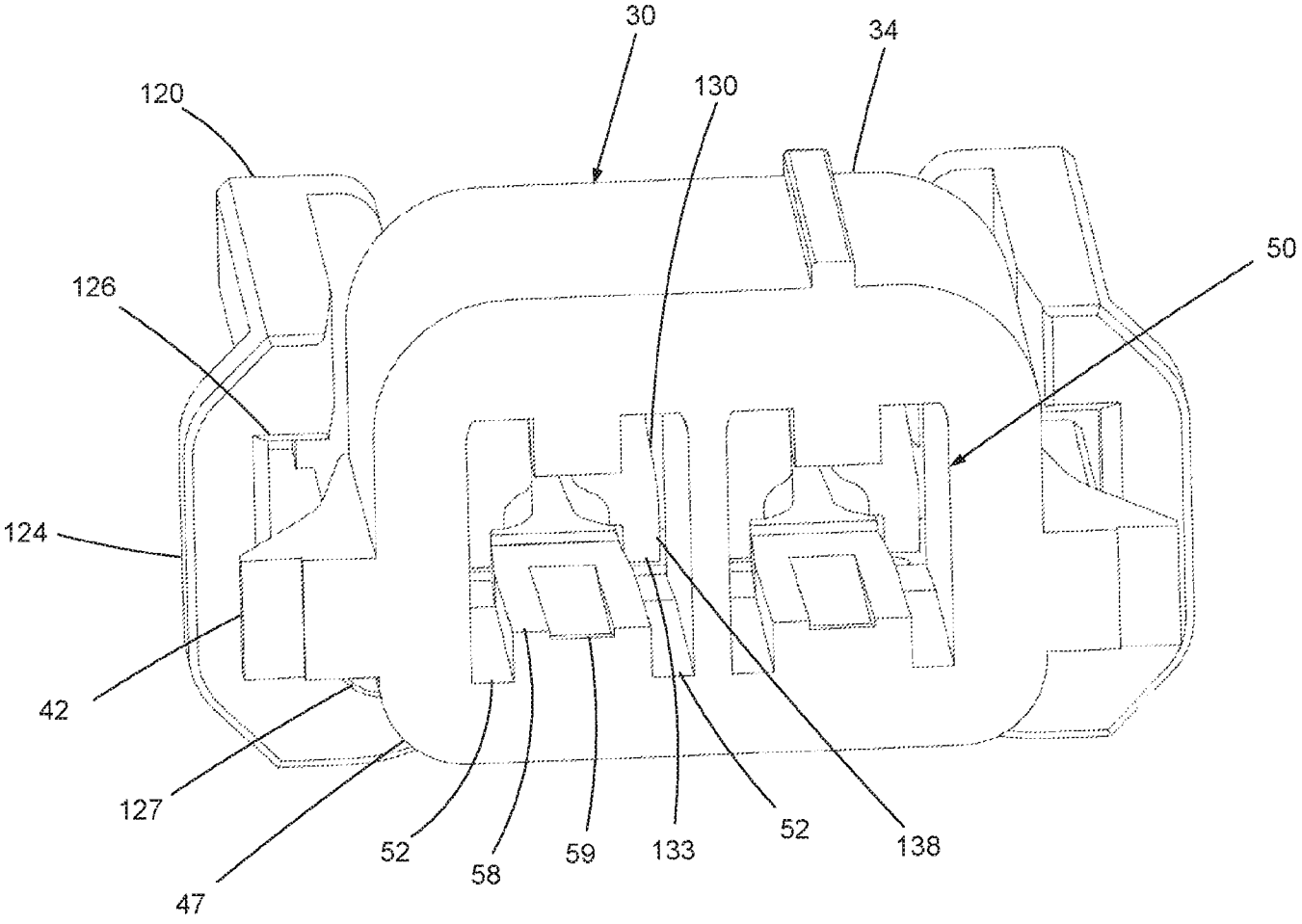
FIG. 16 is a section view of the housing of the connector of the present disclosure.
Figure 17:
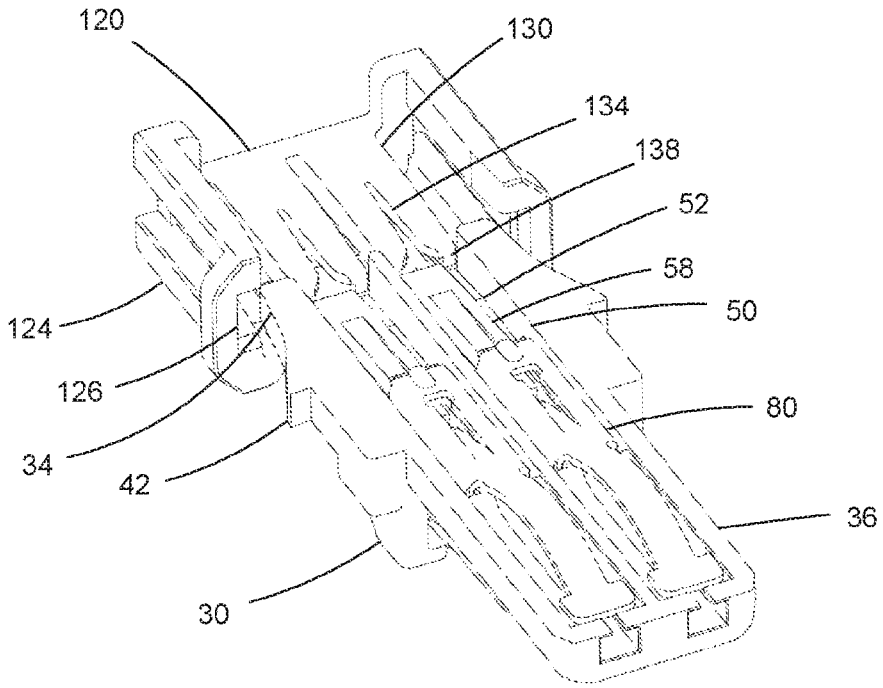
FIG. 17 is a section view showing a sequence of the insertion of a TPA of the connector of the present disclosure.
Figure 18:
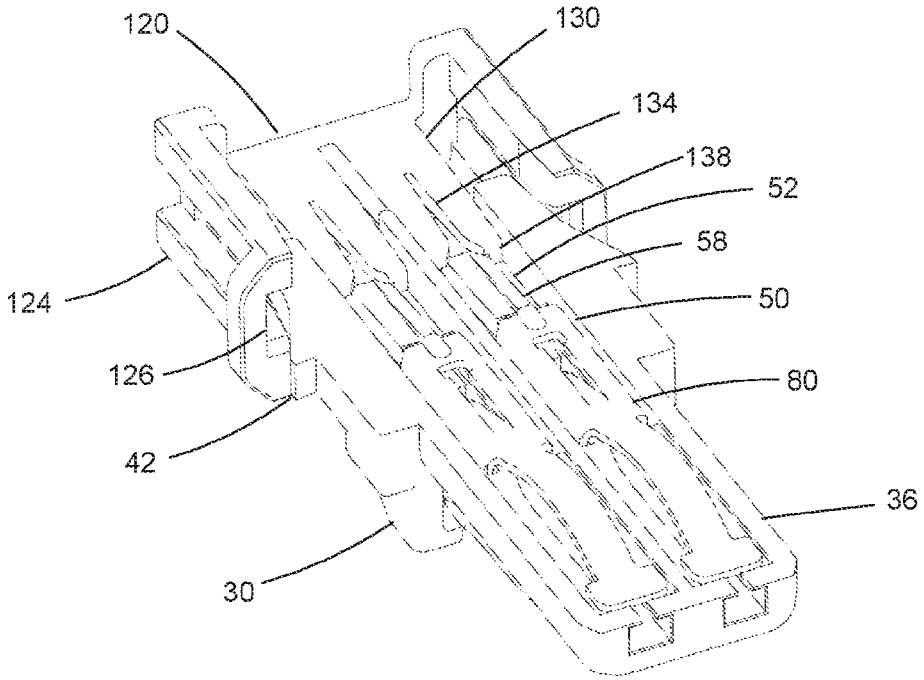
FIG. 18 is a section view showing an additional sequence of the insertion of a TPA of the connector of the present disclosure.

As illustrated in FIGS. 16-20 the installation of the TPA 120 will now be described. FIGS. 16-20 depict the sequence in which the TPA 120 are installed on the connector housing 30. As best shown in FIGS. 16 and 17, the TPA 120 is first aligned with the mounting end 34 of the housing 30 by fitting the guiding surface 127 of the TPA 120 with the guiding surface 47 formed on the housing 30. Each of the locking arms 130 is positioned to enter each respective cavity 50 formed in the housing 30. Upon further insertion, as best illustrated in FIG. 18 each of the side walls 138 formed on the securing arms 130 is guided into the respective slots 52. At this time the side walls 138 engage a side surface of the protrusion 58 allowing the securing arms 130 to be in tight engagement with the protrusion 58. The locking arm essentially "squeezes" the protrusion 58.

Figure 19:
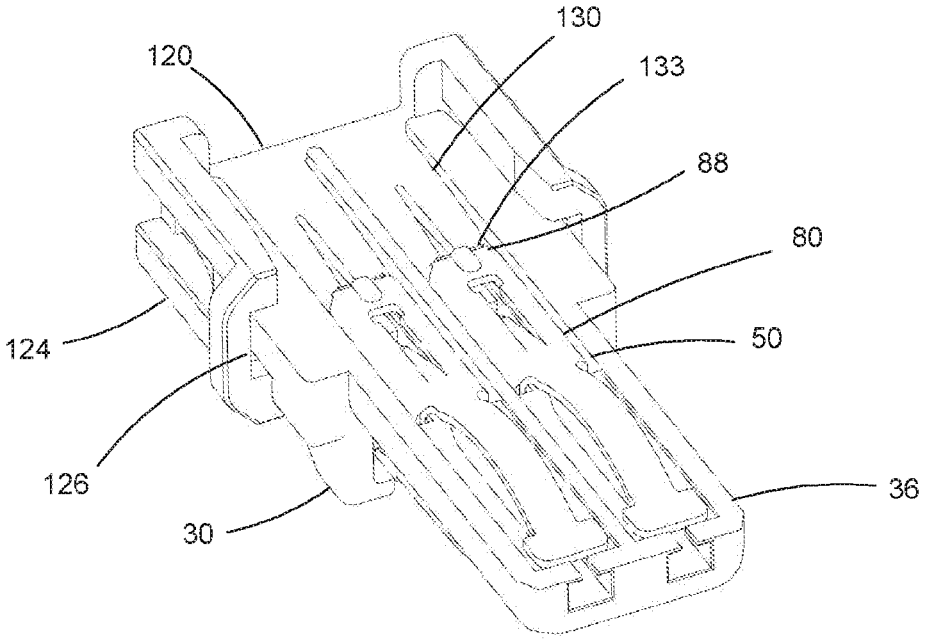
FIG. 19 is a section view showing an additional sequence of the insertion of a TPA of the connector of the present disclosure.
Figure 20:
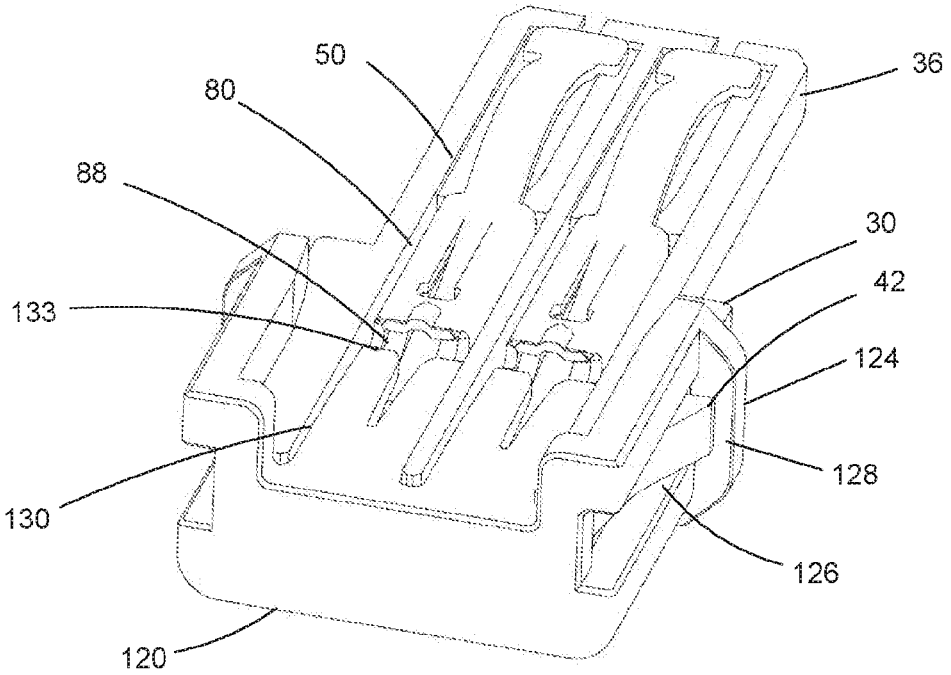
FIG. 20 is an alternative perspective view of the connector of FIG. 19.
Figure 22:
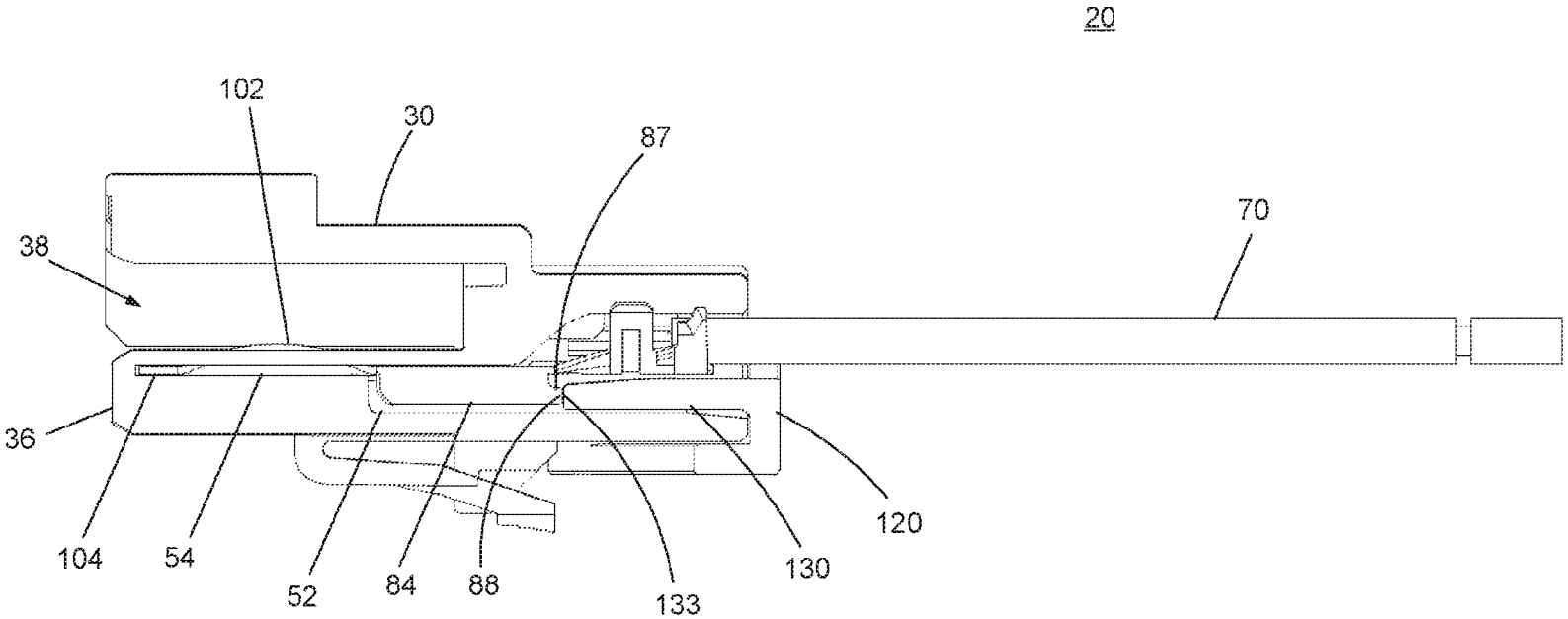
FIG. 22 is an additional section view of the connector assembly of the present disclosure.

Once aligned, the TPA 120 is further advanced to an installed position as shown in FIGS. 19 and 20. At this time the arms 124 are deflected over the ramp 42 with the stop shoulder 128 formed by respective windows 126 positioned behind the ramp 42 locking it in the fully installed positon. A stop surface 133 formed on an end surface of the locking arm 130 abuts the stop surface 88 formed on the end of the tab 87 of the rail 84 of the terminal 80. As best depicted in FIG. 22 the stop surface 133 provides a secondary lock to further secure the terminal 80 in the cavity 50 and resist terminal pull out. Additionally, in cases where the terminal 80 is not fully seated in the cavity 50, the TPA 120 upon insertion, will push the terminal 80 to a fully seated position when it is installed. In instances where the terminal 80 is installed incorrectly, the TPA 120 cannot be advanced to the installed position providing an indication that an incorrectly inserted terminal 80 is present and corrective action is required.

As previously stated, a tight fitting arrangement between the locking arm 130 and the protrusion 58 formed in the cavity 50 provides an improvement in positioning the TPA 120; the ability of the locking arm 130 of the TPA 120 to flex during installation allows for greater tolerance variation. Stated otherwise, the ability of the locking arms 130 of the TPA 120 to flex can compensate for more variance between the protrusion 58 and securing arm 130. Additionally, by being biased to the tight fitting arrangement, it will tend to be in the proper locking position even after deflection. By allowing the front portion of the locking arms 130 to flex during loading the locking arms 130 can expand and adjust to the surface of the protrusion 58. If the securing arm 130 does not deflect, the securing arms 130 may stub and damage the TPA 120 or make it difficult to assemble due to misalignment.

Figure 23:
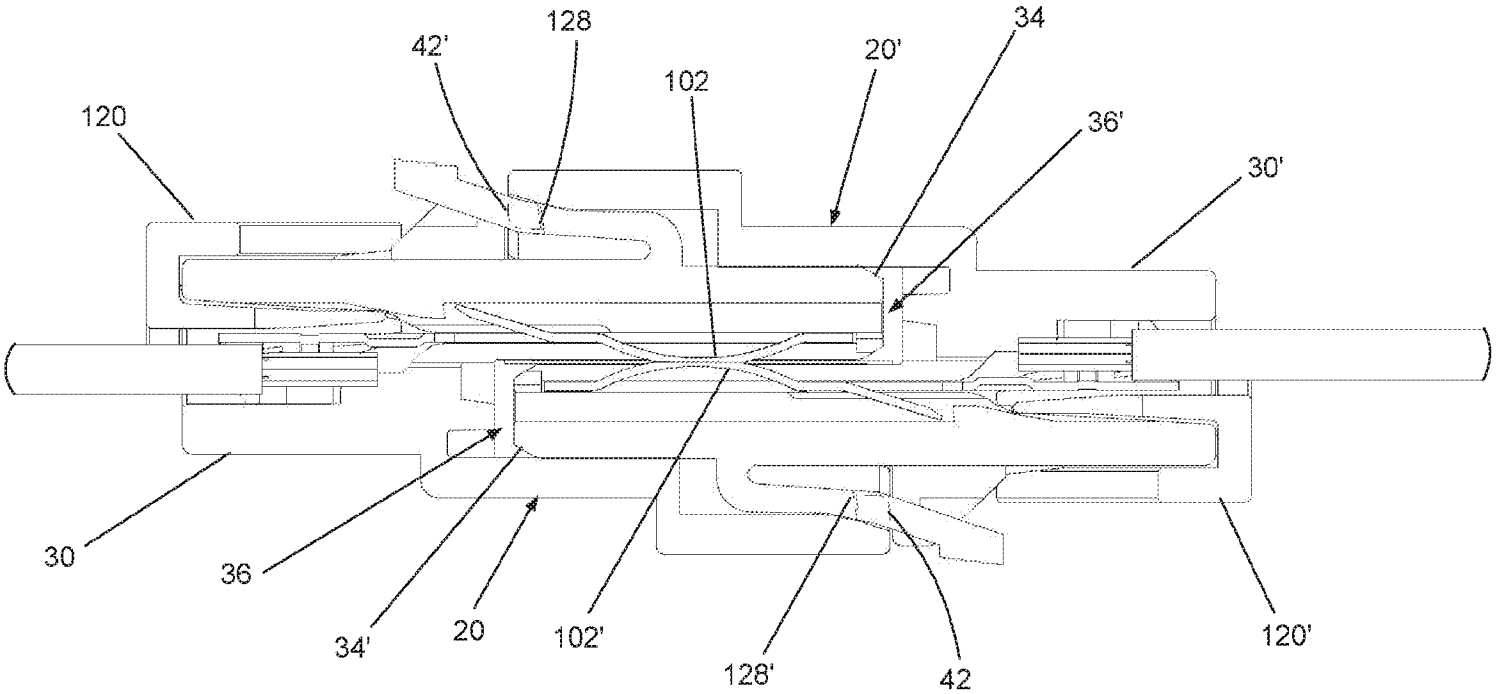
FIG. 23 is a section view of the mated connector assembly system of the present disclosure.

As best shown in FIG. 23 the connectors 20, 20' are shown in the mating condition. The contacting sections 102, 102' that extend into the respective openings 36, 36' engage each other in a direction normal to the mating axis A. The contacting sections 102, 102' deflect as they engage each other generating a normal contacting force between them. With the respective engagement of the mating terminals 80, 80', the contacting sections 102, 102' are deflected upon mutual engagement and tend to flatten out. This causes the each respective securing section 104 of each electrical terminal 80 to translate in the slot 52 allowing for proper electrical engagement between the terminals 80. Upon full engagement of the connectors 20, each stop shoulder 128, 128' of the housings 30, 30' is positioned behind respective lock ramps 42 securing the connectors 20, 20' together in mating arrangement.

The disclosure provided herein describes features in terms of preferred and exemplary embodiments thereof. Numerous other embodiments, modifications and variations within the scope and spirit of the appended claims will occur to persons of ordinary skill in the art from a review of this disclosure.

What is claimed is:

1. A connector comprising:

a housing, the housing having a cavity formed along an insertion direction, the cavity having a pair of spaced apart slots, a protrusion, the protrusion is disposed between the slots of the housing and a shoulder formed in the slots;

a terminal, the terminal configured to be inserted into the cavity, the terminal having a body portion, the body portion having a contacting portion extending along the insertion direction and a wire securing portion extending along the insertion direction, the body portion having a pair of spaced apart rails extending at an angle from the body portion and configured to communicate with the slots formed in the cavity upon insertion of the terminal into the cavity, a tang, the tang is formed in the body portion of the terminal extending between the rails and engages the shoulder formed in the slot upon insertion of the terminal in the housing;

a TPA, the TPA configured to be fixably attached to the housing, the TPA having a locking arm, the locking arm having a pair of spaced apart projections that are configured to be inserted into the slots formed in the cavity of the housing; and wherein the rails formed on the terminal are positioned between the shoulder formed in the slots in the housing and the projections formed on the TPA.

2. The connector according to claim 1, wherein a first distance is defined between the slots formed in the housing and a second distance is defined between the projections on the TPA and wherein the second distance is less than the first distance.

3. The connector according to claim 2, wherein the spaced apart projections engage a side portion of the slots formed in the housing.

4. The connector according to claim 3, wherein a taper is formed on the protrusion.

5. The connector according to claim 1, wherein the connector is a hermaphroditic connector.

6. The connector according to claim 1, wherein the locking arm of the TPA includes a slot formed between the spaced apart projections.

7. The connector according to claim 1, wherein the locking arm of the TPA is U shaped.

8. A connector comprising:

a housing, the housing having a cavity configured to secure a terminal, the housing having a pair of slots formed in the cavity, the slots having a shoulder;

a terminal, the terminal having a body portion, the body portion of the terminal having a pair of spaced apart rails, the rails extend from the body portion at an angle, each rail is disposed in a respective slot upon insertion of the terminal in the cavity;

a TPA, the TPA coupled to the housing, the TPA having a locking arm, a projection is formed on the locking arm, the projection disposed in the slot; and wherein the rail is positioned between the shoulder and the projection.

9. The connector according to claim 8, wherein the projection engages a side wall of the slot.

10. The connector according to claim 8, wherein the locking arm is U shaped.

11. The connector according to claim 10 wherein a slot is formed in the locking arm between the side walls.

* * * * *